United States Patent [19]

Specktor

[11] 4,271,692

[45] Jun. 9, 1981

[54] APPARATUS FOR PIVOTALLY INTERCONNECTING

[76] Inventor: Gerald A. Specktor, 409 Cleveland Ave. S., St. Paul, Minn. 55105

[21] Appl. No.: 19,818

[22] Filed: Mar. 12, 1979

Related U.S. Application Data

[62] Division of Ser. No. 496,848, Sep. 12, 1974, Pat. No. 4,151,737.

[51] Int. Cl.[3] ..... B21D 1/14

[52] U.S. Cl. ..... 72/447; 72/705

[58] Field of Search ..... 72/705, 447; 308/238, 308/151, 139, 23, 2, 31–33; 74/594

[56] References Cited

U.S. PATENT DOCUMENTS

| | | | |
|---|---|---|---|
| 699,003 | 4/1902 | Ohlsson | 308/139 |
| 3,072,448 | 1/1963 | Melton et al. | 308/238 |
| 3,356,426 | 12/1967 | Fadow | 308/238 X |
| 3,377,834 | 4/1968 | Latuff et al. | 72/705 X |
| 3,390,925 | 7/1968 | Fangman | 308/23 X |
| 3,626,747 | 12/1971 | Rouis | 72/705 |
| 3,630,066 | 12/1971 | Chisum | 72/705 X |

FOREIGN PATENT DOCUMENTS

| | | | |
|---|---|---|---|
| 1323163 | 7/1973 | United Kingdom | 72/705 |

*Primary Examiner*—Lowell A. Larson
*Attorney, Agent, or Firm*—Wicks & Nemer

[57] ABSTRACT

Apparatus for pivotally interconnecting a force applying member to an apparatus for repairing and straightening is disclosed in its preferred form for use in repairing and straightening the body and frame of a vehicle. The disclosed apparatus includes a small cylindrical pivot member mounted in a first stationary position located adjacent the front of an apparatus for repairing and straightening and second and third small cylindrical pivot members mounted to a tram movable within the apparatus for repairing and straightening. A force applying member in the form of an elongatable pull tower is shown together with a connector arm which extends from the pull tower to a point adjacent to the pivot member. A clamp member and a ring sleeve type bearing are provided according to the present invention to pivotally mount the connector arm to one of the pivot members. Thus, under the teachings of the present invention, the counterforces applied to the connector arm by the pull tower can be conveyed to the pivot member from any direction. Further provided according to the present invention are positioning and leveling members including a thrust plate and adjustment screws which abut with the thrust plate. A nylon type bearing is also provided between the thrust plate and the clamp member to reduce the amount of friction between the thrust plate and the clamp member when the connector arm is pivoted about pivot member.

6 Claims, 3 Drawing Figures

APPARATUS FOR PIVOTALLY INTERCONNECTING

CROSS REFERENCE

This is a division of application Ser. No. 496,848 filed Sept. 12, 1974, by the same inventor, now U.S. Pat. No. 4,151,737 granted May 1, 1979.

BACKGROUND

This invention relates generally to apparatus for pivotally interconnecting and more particularly, in the preferred embodiment, to apparatus for pivotally interconnecting a force applying member to an apparatus for repairing and straightening.

In the field of vehicle frame and body repairing and straightening, various types of apparatus for pivotally interconnecting are currently available but present serious limitations and deficiencies regarding the ability to convey the counterforce applied by the force applying members to the pivot member from any direction. Presently, for example, a repairing force cannot be exerted in a direction away from the tread member of the apparatus for repairing and straightening.

Therefore, there is a definite need in the art for an apparatus for pivotally interconnecting a force applying member to an apparatus for repairing and straightening which allows the counterforce to be applied to the pivot member from any direction. Therefore, a pulling force can be applied from any direction around the force applying member, even in a direction away from the tread member of the apparatus for repairing and straightening.

There is also a definite need in the art for apparatus for pivotally interconnecting force applying members to an apparatus for repairing and straightening which can easily be pivoted in the apparatus for repairing and straightening to reduce the amount of physical labor required to operate. Further, the apparatus should be of simple design, efficient, and easy to operate to reduce the amount of time, effort, and labor required for the repair of damages and to maximize the equipment and materials used.

SUMMARY

The present invention solves these and other problems in apparatus for pivotally interconnecting by providing in the preferred embodiment, an apparatus for pivotally interconnecting a force applying member to an apparatus for repairing and straightening. The apparatus includes, in the preferred embodiment, a small cylindrical pivot member mounted to the apparatus for repairing and straightening, and a member for pivotally mounting the connector arm of the force applying member to the pivot member. The apparatus has the ability to apply a counterforce from the connector arm to the force applying member from any direction around the force applying member.

In the preferred embodiment, a member for positioning and leveling the connector arm on the pivot member is further included.

Therefore, it is a primary object of this invention to provide novel apparatus for pivotally interconnecting.

It is also an object of this invention to provide novel apparatus for pivotally interconnecting a force applying member to an apparatus for repairing and straightening.

It is also an object of this invention to provide novel apparatus for pivotally interconnecting which is able to convey a counter force applied by the force applying member to the apparatus for repairing and straightening from any direction.

It is also an object of this invention to provide novel apparatus for pivotally interconnecting a force applying member to an apparatus for repairing and straightening which allows the pivoting of the force applying members on the apparatus for repairing and straightening without the expenditure of large amounts of human force.

These and further objects and advantages of the present invention will become clearer in light of the following detailed description of an illustrative embodiment of this invention described in connection with the drawings.

DESCRIPTION OF OF THE DRAWINGS

The illustrative embodiment may best be described by reference to the accompanying drawings where:

Figures 1, 4, 7:
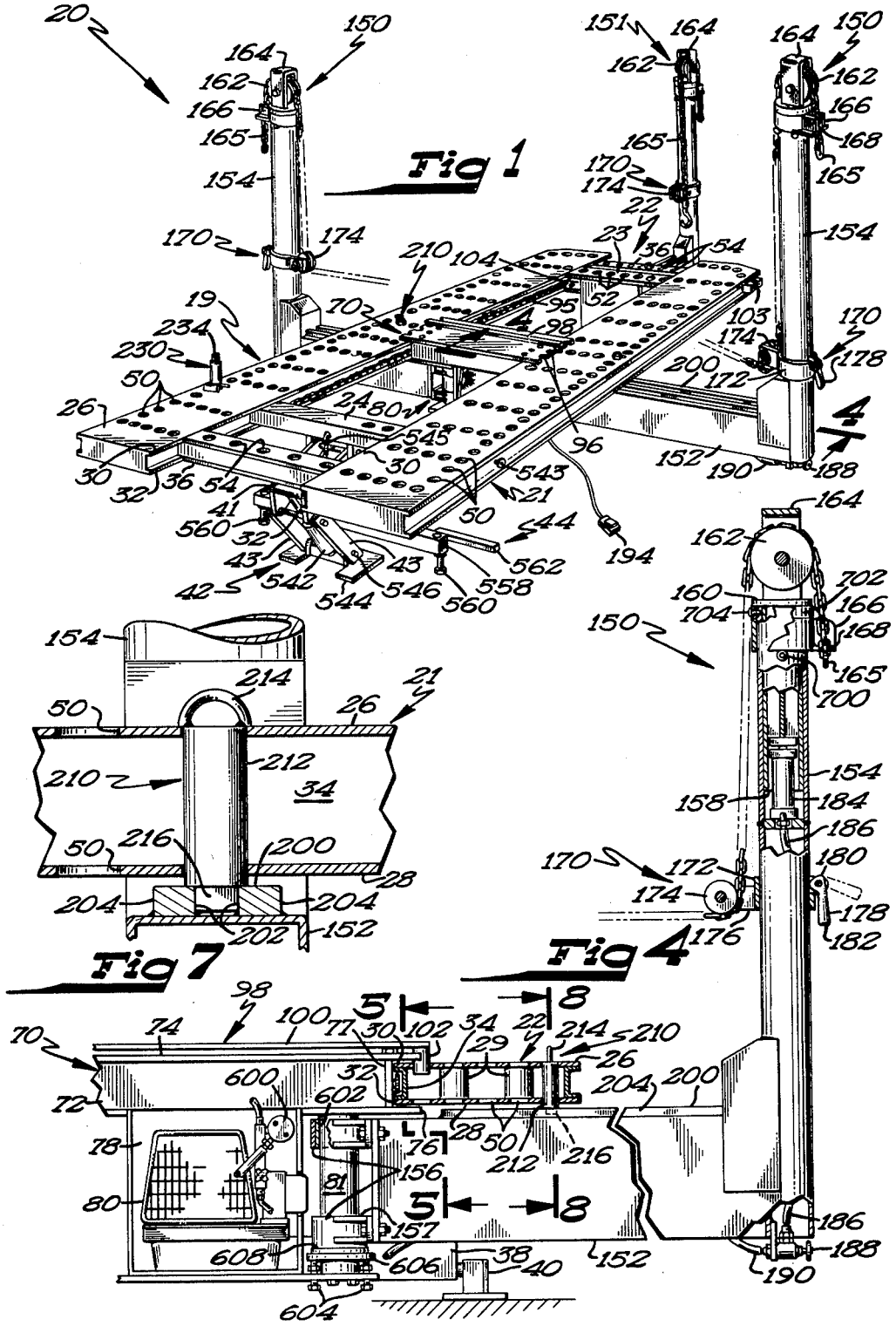
FIG. 1 is a perspective view of an apparatus for repairing and straightening the body and frame of a vehicle utilizing the apparatus for pivotally interconnecting according to the teachings of the present invention.
FIG. 4 is a partial sectional view taken along Section line 4—4 in FIG. 1.
FIG. 7 is a partial sectional view taken along Setion line 7—7 in FIG. 3.

The remaining figures of the drawings of the present invention and the remaining disclosure of the present invention, including preferred embodiments, are incorporated herein by reference to application Ser. No. 496,848 filed Aug. 12, 1974, by Gerald A. Specktor, entitled "Apparatus for Repairing and Straightening", now U.S. Pat. No. 4,151,737, the parent application of the present application.

What is claimed is:

1. Apparatus for pivotally interconnecting force applying means to an apparatus for repairing and straightening the body and frame of a wheeled vehicle comprising, in combination: a small cylindrical pivot member mounted to the apparatus for repairing and straightening; a connector arm extending from the force applying means to a point adjacent the pivot member; and means for pivotally mounting the connector arm to the pivot member and for allowing the counterforce applied to the connector arm by the force applying means to be conveyed to the pivot member from any direction comprising, in combination: a first clamp member pivotably connected about the pivot member; a first ring-sleeve type bearing located between the first clamp member and the pivot member; a second clamp member pivotably connected about the pivot member and spaced from the first clamp member; a second ring-sleeve type bearing located between the second clamp member and the pivot member; and means for positioning and leveling the connector arm on the pivot member comprising, in combination: a thrust plate; and adjustment screws abutting the thrust plate, wherein the means for pivotally mounting the connector arm to the pivot member and for allowing the counterforce applied to the connector arm by the force applying means to be conveyed to the pivot member from any direction operatively rests on the thrust plate.

2. The apparatus of claim 1 further comprising, in combination: means for reducing the friction between the thrust plate and the means for pivotally mounting the connector arm to the pivot member and for allowing the counterforce applied to the connector arm by the force applying means to be conveyed to the pivot member from any direction.

3. Apparatus for pivotally interconnecting force applying means to an apparatus for repairing and straightening the body and frame of a wheeled vehicle comprising, in combination: a pivot member mounted to the apparatus for repairing and straightening; a connector arm extending from the force applying means to a point adjacent the pivot member; means for pivotally mounting the connector arm to the pivot member; and means for positioning and leveling the connector arm on the pivot member comprising, in combination: a thrust plate, and adjustment screws abutting the thrust plate, wherein the means for pivotally mounting the connector arm to the pivot member operatively rests on the thrust plate.

4. The apparatus of claim 3 further comprising, in combination: means for reducing the friction between the thrust plate and the means for pivotally mounting the connector arm to the pivot member.

5. The apparatus of claim 3 or 4 wherein the means for pivotally mounting the connector arm to the pivot member comprises: means for pivotally mounting the connector arm to the pivot member and for allowing the counterforce applied to the connector arm by the force applying means to be conveyed to the pivot member from any direction.

6. The apparatus of claim 5 wherein the means for pivotally mounting the connector arm to the pivot member for allowing the counterforce applied to the connector arm by the force applying means to be conveyed to the pivot member from any direction comprises, in combination: a first clamp member pivotally connected about the pivot member; a first ring-sleeve type bearing located between the first clamp member and the pivot member; a second clamp member pivotally connected about the pivot member and spaced from the first clamp member; and a second ring-sleeve type bearing located between the second clamp member and the pivot member.

* * * * *